United States Patent [19]

Lambert

[11] Patent Number: 4,666,791

[45] Date of Patent: May 19, 1987

[54] NI-ZN ELECTROPLATED PRODUCT RESISTANT TO PAINT DELAMINATION

[75] Inventor: Michael R. Lambert, Quakertown, Pa.

[73] Assignee: Bethlehem Steel Corporation of Delaware, Bethlehem, Pa.

[21] Appl. No.: 805,658

[22] Filed: Dec. 6, 1985

[51] Int. Cl.[4] ..... B21D 39/00

[52] U.S. Cl. ..... 428/621; 428/624

[58] Field of Search ..... 428/621, 624

[56] References Cited

U.S. PATENT DOCUMENTS 1,268,987 6/1918 McMullen ..... 428/624
3,119,712 1/1964 Esswein ..... 428/624
4,374,902 2/1983 Smith ..... 428/621
4,500,610 2/1985 Gunn ..... 428/621

*Primary Examiner*—Peter D. Rosenberg
*Attorney, Agent, or Firm*—William B. Noll

[57] ABSTRACT

This invention is directed to an improved electroplated and painted product that is resistant to corrosive damage as measured on painted and scribed panels subjected to salt spray and cyclic humidity exposure, such as used to judge corrosion behavior of an automotive body panel. The electroplate layer, underlying a paint layer, is characterized by a two-phase structure and is composed of an alloy of 6.5 to 9.5%, by weight nickel, balance essentially zinc.

2 Claims, 3 Drawing Figures

Salt Spray - Painted and Scribed
Corrosion Resistance vs. Nickel Concentration

NI-ZN ELECTROPLATED PRODUCT RESISTANT TO PAINT DELAMINATION

BACKGROUND OF THE INVENTION

The present invention is directed to an electroplated and painted steel substrate which exhibits improved corrosion and paint delamination resistance.

Steel has been known and used for years as a construction product However, an accepted condition of such use, depending on the environment to which the steel was exposed, was that the steel was subject to corrosive attack. In the desire to minimize such attack, workers in the art sought out methods and protective coatings for the steel. Today, zinc is one of the most widely used metallic coatings applied to steel surfaces to protect them against corrosive attack. Two principal methods of applying such coatings are (1) hot-dipping, and (2) electroplating. Hot-dipping has the advantage of cost and ease of application. However, hot-dipping typically results in a thick coating with a rough surface, and an intermetallic alloy interface between the steel substrate and coating overlay. As a consequence, the formability and appearance of hot-dip products is limited, thus making such product unacceptable for many applications.

In contrast, electroplated zinc (1) produces smooth, thinner coatings, (2) is applied at lower temperatures, which means the base steel is less affected by such temperatures, and (3) results in little or no formation of an intermetallic alloy interface. Thus, where forming is a critical step in the fabrication of a product, electroplated zinc is the preferred product.

Zinc, when applied as a thin electroplated coating to steel, offers only minimum protection against corrosion. This shortcoming of pure zinc led to further research to improve the corrosion resistance of electroplated coatings. In addition, at points where there are breaks in the coating down to the base steel, extensive corrosion of the zinc coating under the paint film (layer) occurs, which causes severe paint delamination.

Shanz, in U.S. Pat. No. 2,419,231, teaches that a zinc electroplated coating, containing nickel, improves the corrosion resistance of the coating layer. The Ni-Zn alloy compositions suggested by Shanz contain 10 -24% Ni, balance Zn. A preferred feature of the Shanz product is the application of a pure nickel layer on the steel prior to the electrocoating with Ni-Zn.

Subsequent developments, such as described in the patents to Roehl, No. 3,420,754; Roehl, et al., No. 3,558,442; and Hirt, et al., No. 4,282,073, have generally sought to further improve the corrosion resistance through changes or controls imposed on the coating practices, and/or changes to the coating composition. None, however, have addressed themselves to the problem and solution of resistance to paint delamination. Applicant will discuss the latter in the specifications which follow.

SUMMARY OF THE INVENTION

This invention relates to a Ni-Zn electroplated and painted product which represents an optimum compromise between galvanic and barrier corrosion protection. Additionally, such Ni-Zn alloy, when comprised of from 6.5 to 9.5%, by weight nickel, balance essentially zinc, is characterized by a two-phase structure. Such structure renders the painted and coated product uniquely resistant to paint delamination.

DESCRIPTION OF PREFERRED EMBODIMENT OF THE INVENTION

Figure 1:
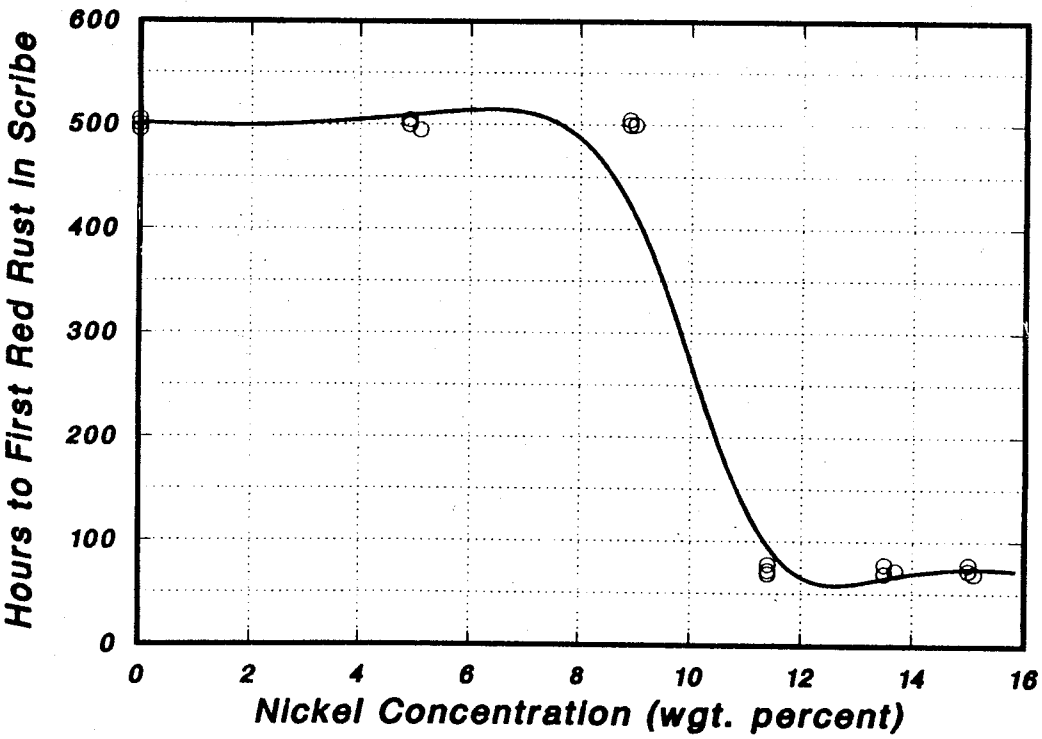
FIG. 1 is a graphic presentation of data showing corrosion rates on painted and scribed Ni-Zn electroplated steel in a salt spray test.

In the practice of this invention the precise method of electroplating the steel substrate forms no part of this invention. Nevertheless, for convenience, the further description, and testing hereunder, will be directed to a coating operation in which the coating was plated from a nickel sulfate/zinc sulfate plating bath.

To develop the data presented in the FIGURES, and to demonstrate the unique features of the product of this invention, a series of steel panels were prepared. The Ni-Zn alloy coatings were electroplated on 0.035 inch thick, DQSK grade steel sheet to a coating weight of 45 g/m$^2$ To obtain coating compositions between 0 and 15% Ni the plating conditions and bath composition were varied according to the plating conditions listed below in TABLE I.

TABLE I

| Coating Composition % Ni | Plating Conditions: Current Density (ASF) | Bath Temp. °C. | Line Speed (ft./min.) |
|---|---|---|---|
| 0 | 500 | 55 | 315 |
| 5 | 250 | 60 | 315 |
| 9 | 250 | 70 | 470 |
| 11 | 250 | 66 | 330 |
| 13 | 250 | 70 | 195 |
| 15 | 250 | 60 | 315 |

For each coating composition a number of panels were phosphated and painted with a cationic electrophoretic primer (e-coat) according to the procedure listed in TABLE II. These panels were then scribed diagonally through the primer and coating, down to the steel substrate.

TABLE II

E-coating procedure

1. Alkaline cleaner, Parco 348, 150° F., 30 sec.
2. Hot water rinse, 30 sec.
3. Prephosphate, Parco 2 Rinse, ambient temp., 10 sec.
4. Phosphate, Bonderite EP-1, 140 ° F., 60 sec. spray
5. Cold water rinse
6. Chromate rinse, Parco 60, 120 ° F., 15–30 sec.
7. Distilled water rinse
8. Oven dry, 140° F.
9. Electrophoretic primer, Uniprime, 180 V, 135 sec.
10. Hot water rinse
11. Air dry
12. Oven cure, 360° F., 20 min.

Data for the electroplated Ni-Zn samples was developed in both salt spray and cyclic accelerated corrosion tests. The salt spray tests were conducted according to ASTM specification B117 on flat unpainted samples, and flat painted and scribed samples. The painted and scribed samples were removed after 500 hours and rated for the amount of red rust coverage in the scribe. The loose paint was then removed with a jet of compressed air and the average delamination distance from the scribed measured. For the cyclic data, the panels were removed and rated after 20 cycles.

The corrosion performance of the painted and scribed Ni-Zn coated panels demonstrated that the best protection against red rust formation, under these test conditions, was provided by the pure zn electroplate and become progressively worse with increasing Ni content. However, the severity of paint delamination on the painted and scribed panels was also observed to vary with the Ni content of the coating. The 0 to 5% Ni coatings showed severe coating dissolution from beneath the paint. It is believed that this is due to the very active nature of these coatings. That is, such coatings readily dissolve to protect the scribe area, undercutting the paint film in the process.

Figure 2:
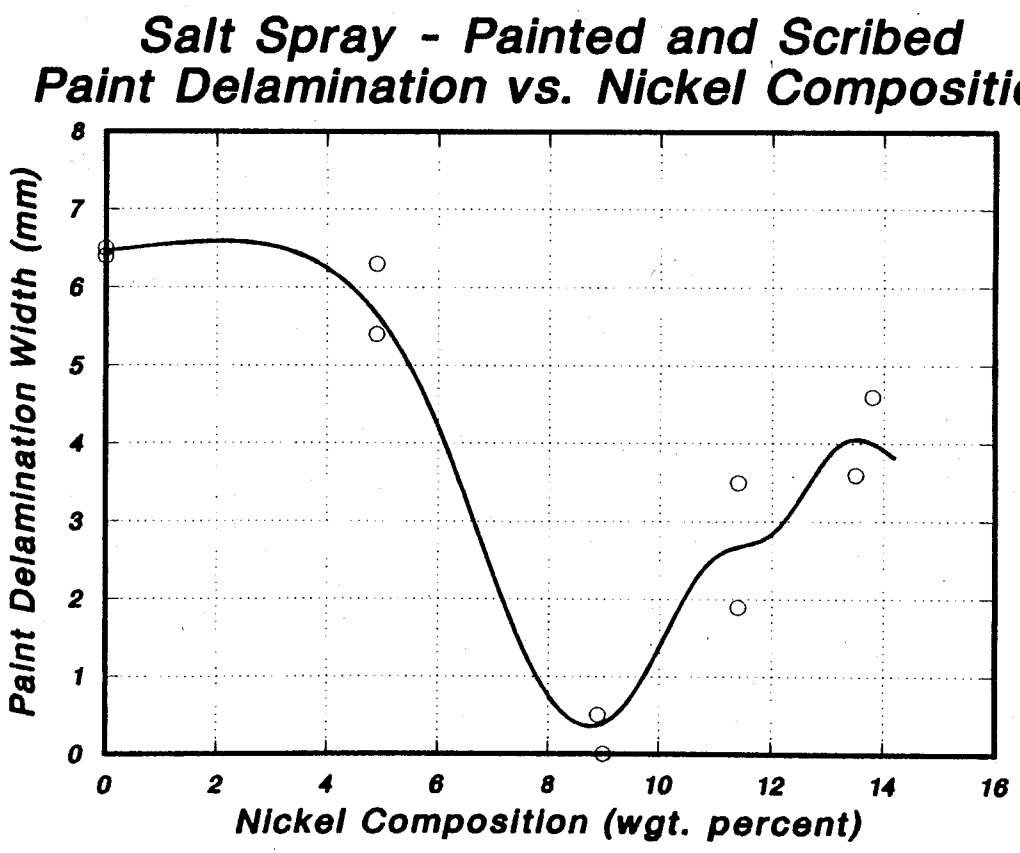
FIG. 2 is a graphic presentation of data showing paint delamination tests on painted and scribed Ni-Zn electroplated steel in salt spray test.
Figure 3:
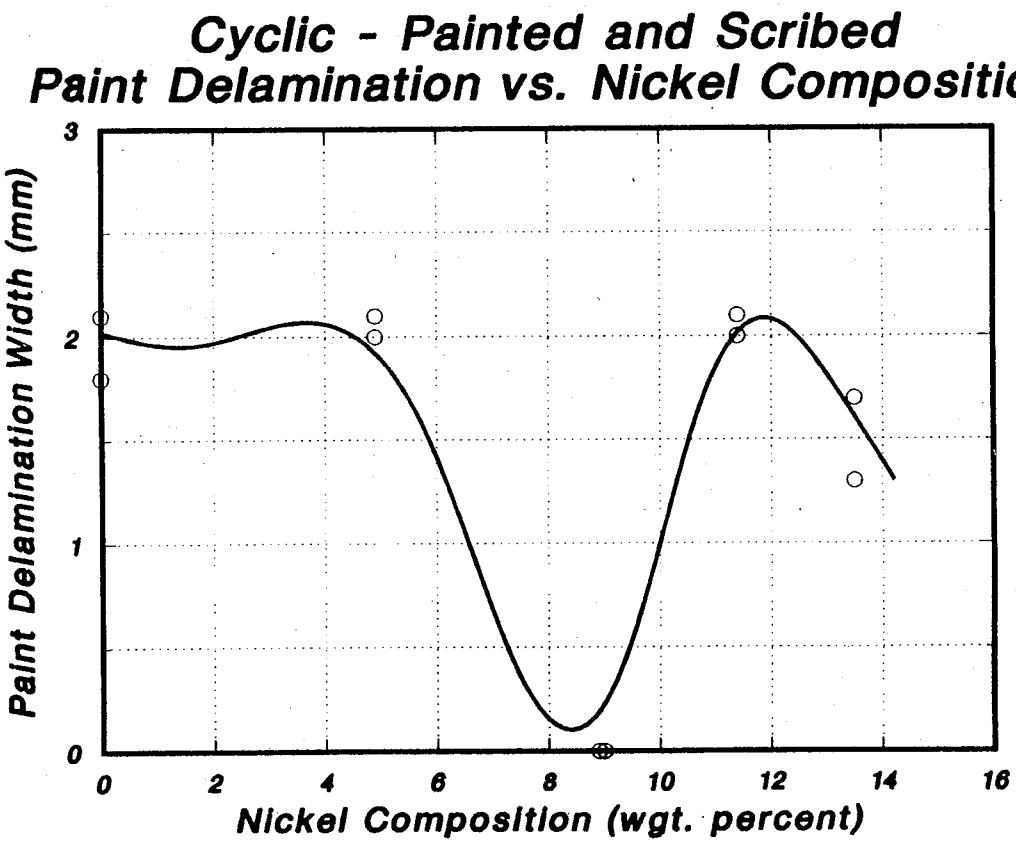
FIG. 3 is a graphic presentation of data showing paint delamination tests on painted and scribed Ni-Zn electroplated steel in a cyclic test.

Unexpectedly, the appearance of the 9% Ni-Zn coating was much different. There was very little undercutting of the paint along the scribe even though the 9% Ni-Zn coating is considered fairly active. For such a coating, tiny pinhole blistering was observed in the paint bordering the scribe. Despite such pinholes, the unblistered paint in these areas was quite adherent. Without desiring to be bound to any given theory, it has been theorized that the superior delamination resistance of the 9% Ni-Zn coating is related to its dual phase structure, and/or mechanical keying effects of its columnar surface morphology. The higher Ni coatings, in general, exhibit greater undercutting than the 9% Ni-Zn coating but less than the lower Ni coatings, see FIG. 2.

This dual phase structure was observed for the intermediate coatings, i.e., in the range of about 6.5 to 9.5%, by weight Ni, balance essentially Zn. Using X-ray diffraction, it was discovered, for example, that the 5 and 9% Ni coatings contain two phases, eta (Zn with Ni in solid solution) and gamma ($Ni_5 Zn_{21}$) Ni coating consists solely of eta phase, while the 11, 13 and 15% Ni coatings consist solely of gamma phase. The transition from gamma to gamma plus eta occurs at about 9.5% Ni, while the transition from gamma plus eta to eta was observed to occur around 4% Ni. In the two phase region the gamma phase experiences a change in preferred orientation changes from (110), (411) type to (311), (321). Additionally, at 9% Ni, the coating exhibits unique columnar protrusions.

Finally, the surface morphology was studied through SEM photomicrographs. All of the coatings were fairly flat and continuous, except for the 9% Ni-Zn coating which had circular columns, approximately 4–5 μm in diameter and 5–15 μm in height, sticking out from the coating surface. The Zn and 5% Ni-Zn coatings exhibited some crystallographic facetting, while the 11, 13 and 15% Ni-Zn coatings contained a few small surface cracks.

Metallography and SEM X-ray analysis indicated that the two phase coatings have a very fine and totally uniform distribution of the two phases. Since these phases could not be distinguished using EDS analysis, it was surmised that their size is less than 2 μm.

The product of this invention is particularly suited for automotive applications, as it offers significant levels of both barrier and galvanic corrosion protection, as well as excellent resistance to paint dalamination.

I claim:

1. An electroplated and painted steel substrate product having improved corrosion and paint dalamination resistance, comprising a steel substrate having a single electroplated coating layer with a two-phase structure consisting of 6.5 to 9.5%, by weight nickel, balance essentially zinc, on at least one surface of said substrate, and a painted layer over said electroplated coating layer, whereby the resulting composite product is resistant to paint delamination as measured in salt spray and cyclic tests.

2. The electroplated product according to claim 1 wherein said coating structure comprises eta and gamma phases.

* * * * *